US006708954B2

(12) United States Patent
Chambers

(10) Patent No.: US 6,708,954 B2
(45) Date of Patent: Mar. 23, 2004

(54) WINCH

(75) Inventor: Christopher Paul Chambers, Auckland (NZ)

(73) Assignee: Maxwell Marine Limited, Auckland (NZ)

( * ) Notice: Subject to any disclaimer, the term of this patent is extended or adjusted under 35 U.S.C. 154(b) by 0 days.

(21) Appl. No.: 10/311,367

(22) PCT Filed: Jun. 15, 2001

(86) PCT No.: PCT/NZ01/00112

§ 371 (c)(1),
(2), (4) Date: Dec. 16, 2002

(87) PCT Pub. No.: WO01/96227

PCT Pub. Date: Dec. 20, 2001

(65) Prior Publication Data

US 2003/0102397 A1 Jun. 5, 2003

(30) Foreign Application Priority Data

Jun. 16, 2000 (NZ) ..... 505262
Jun. 19, 2000 (NZ) ..... 505303
Oct. 26, 2000 (NZ) ..... 507815

(51) Int. Cl.[7] ..... B66D 1/14
(52) U.S. Cl. ..... 254/339; 254/333
(58) Field of Search ..... 254/333, 339, 254/340, 365; 192/95; 74/625

(56) References Cited

U.S. PATENT DOCUMENTS 4,020,630 A 5/1977 DeShetler
4,083,510 A 4/1978 Gomez
4,215,850 A * 8/1980 Haase et al. ..... 254/350
4,362,292 A 12/1982 Rowan et al.
5,374,035 A * 12/1994 Santos ..... 254/339
5,596,936 A 1/1997 Bullock et al.
6,394,421 B1 * 5/2002 Henly ..... 254/365
6,554,255 B2 * 4/2003 Fujikawa ..... 254/358

FOREIGN PATENT DOCUMENTS

WO 96/09980 4/1996
WO 01/35712 5/2001

* cited by examiner

*Primary Examiner*—Kathy Matecki
*Assistant Examiner*—Evan Langdon
(74) *Attorney, Agent, or Firm*—Pillsbury Winthrop LLP

(57) ABSTRACT

A winch includes a chain wheel mounted on a spindle. A clutch is provided to selectively engage or disengage the chain wheel with the spindle. A clutch nut having a central aperture is movable rotationally and longitudinally on the spindle by way of mutually engaging threads on the spindle and central aperture. A stop is provided on the spindle to prevent longitudinal movement of the clutch nut away from the chain plates beyond a predetermined position. A carrier rotates on the spindle and rotational direction limiting structure is provided between the carrier and the spindle. Rotation structure rotates the carrier with respect to the clutch nut so that by rotating the rotation structure in one direction the clutch nut is moved towards the chain wheel to cause the chain wheel to be rotated by the spindle, and by rotating the rotation structure in the opposite direction, the clutch nut moves away from the chain wheel to release the chain wheel from the spindle, engagement of the clutch nut with the stop causing the carrier to rotate thereby rotating the chain wheel without rotation of the spindle.

3 Claims, 6 Drawing Sheets

WINCH

This application is the National Phase of International Application PCT/NZ01/00112 filed Jun. 15, 2001, which designated the U.S. and that International Application was published under PCT Article 21(2) in English.

TECHNICAL FIELD OF THE INVENTION

This invention relates to winches, particularly winches used on boats or other water vessels to raise and lower an anchor. Other uses of the invention are envisaged.

BACKGROUND ART

With winches presently available to raise or lower an anchor, difficulties are met particularly when the anchor is mounted on a chain. These difficulties include connections between a chain and a rope which cause an oversize section in the rope where the connection is made. If the chain jams, unlike a rope, the chain cannot be pushed to force the chain about the capstan of the winch. Furthermore should, for example, the battery run down, it would be desirable to provide a manual override so as to be able to drive the shaft by hand, in particular, to raise the anchor.

OBJECT

It is an object of the present invention to provide variations on winches and/or the rope or chains passing around the winch which will obviate or minimise the foregoing disadvantages in a simple yet effective manner and/or go at least some distance towards meeting the foregoing requirement in a simple yet effective manner or which will at least provide the public with a useful choice.

DISCLOSURE OF INVENTION

Accordingly in one aspect, the invention consists in a winch, including a chain wheel mounted on a spindle, a clutch to selectively engage or disengage the chain wheel with the spindle, a clutch nut having a central aperture, the clutch nut being movable rotationally and longitudinally on the spindle on mutually engaging threads on the spindle and central aperture, a stop on the spindle to prevent longitudinal movement of the clutch nut away from the chain plates beyond a predetermined position, a carrier rotatable on the spindle, a rotational direction limiting means between the carrier and the spindle, and rotation means to rotate the carrier with respect to the clutch nut, so that by rotating the rotation means in one direction the clutch nut is moved towards the chain wheel to cause the chain wheel to be rotated by the spindle, and by rotating the rotation means in the opposite direction, the clutch nut moves away from the chain wheel to release the chain wheel from the spindle, engagement of the clutch nut with the stop causing the carrier to rotate thereby rotating the chain wheel without rotation of the spindle.

Preferably the carrier has a movable dog and an adjacent chain wheel part has a lug thereon, the dog being manually moveable so that the dog engages the lug when the clutch nut is moved towards the stop, and manually movable so that the lug is free from the dog when the clutch nut is moved away from the stop and towards the chain wheel.

Preferably the one way drive comprises a toothed wheel mounted on the spindle to rotate with the spindle and one or more pawls on the carrier.

In a further aspect the invention consists in a chain wheel part comprising a disk, a plurality of teeth on the disk, the teeth not extending to the perimeter of the disk, and a plurality of spines, the spines being positioned on or at least on some teeth and extending to or adjacent the periphery of the drive.

Preferably the teeth are mounted on a central portion displaced from the plane of the disk and the spines are positioned on the outer most extremity of a tooth on which they are placed, the spine extending down an outwardly facing face of a tooth, and across a the peripheral area of the disk.

In a still further aspect the invention consists in a guide for a rope or chain comprising a base plate, an arcuate first arm pivoted to the base plate, an arcuate second arm pivotally connected to the first arm and so as in a rest position to form an acute angle with the first arm, and biasing means between the base plate and the second arm.

Preferably the base plate carries a chain wheel and the arms are positioned adjacent the periphery of the chain wheel.

Preferably the biasing means comprises a spring connected to the second arm at a position between the pivot points between the base plate and first arm and between the first and second arms.

Preferably the second arm carries a pressure member.

In a still further aspect the invention consists in a guide for a rope or chain comprising a base plate, an arm pivotally mounted on the base plate, biasing means between the base plate and the arm, and a pressure member on the arm.

Preferably the pressure member is pivotally mounted on the arm.

Preferably the arm is substantially arcuate.

Preferably the pressure member is substantially arcuate.

Preferably the pivot point of the pressure member is adjacent the convex face of the substantially arcuate pressure member.

Preferably the base plate carries a chain wheel pair, the pivot point of the arm to the base being adjacent the periphery of the chain wheel or wheels.

Preferably the pivot point between the arm and the pressure member is displaced from the centre point of the pressure member towards the pivot point between the arm and base.

Preferably the biasing means comprises a spring.

In a still further aspect the invention consists in a winch including a guide according to the preceding paragraphs.

In a still further aspect the invention consists in a chain, holding means being provided to bias adjacent links of the chain to a position where the links of the chain are closely adjacent.

Preferably the holding means comprises a tie about adjacent lengths.

Alternatively the holding means comprises a pressure block positioned in the aperture of one or more links.

To those skilled in the art to which the invention relates, many changes in construction and widely differing embodiments and applications of the invention will suggest themselves without departing from the scope of the invention as defined in the appended claims. The disclosures and the description herein are purely illustrative and are not intended to be in any sense limiting.

BRIEF DESCRIPTION OF DRAWINGS

On preferred form of the invention will now be described with reference to the accompanying drawings in which.

BEST MODE FOR CARRYING OUT THE INVENTION

Figure 1:
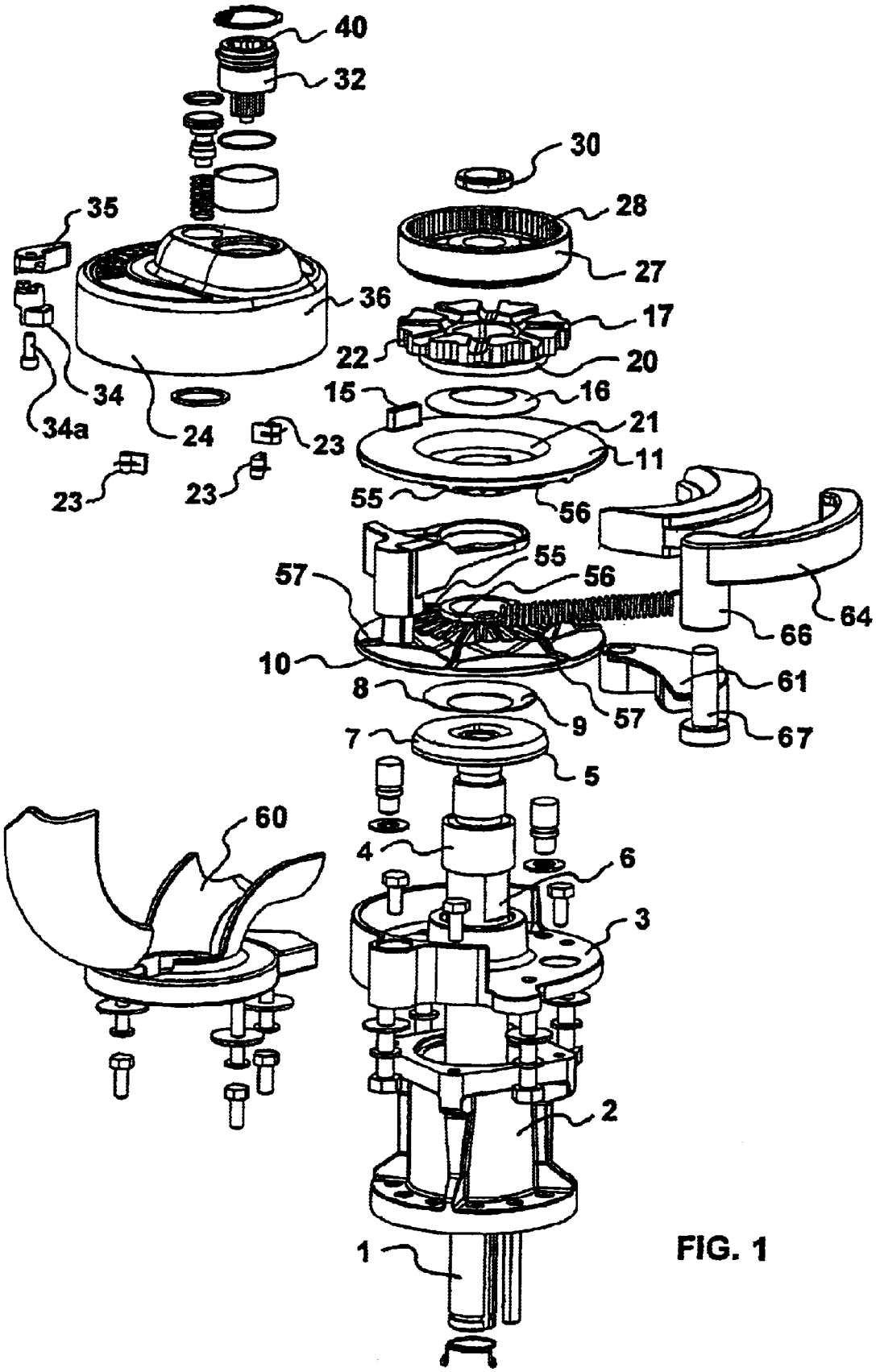
FIG. 1 is an exploded view of a winch according to one preferred form of the invention.

Referring to the winch shown in FIG. 1, the winch comprises a spindle 1 which passes through a spacer tube 2. Connected to the spacer tube 2 is a deck plate 3 through which spindle 1 passes. The spindle 3 is threaded at 4 (the threads not being shown) as will be described further herein.

A lower clutch cone 5 is mounted to the spindle 1 so that the clutch cone 5 can move longitudinally but is prevented from rotation by the provision of flats on the spindle 1 with co-operating flats on the central aperture of the lower clutch cone 5. The cone 5 has an upwardly inwardly chamfered face 7. A belleville washer 8 is positioned above the cone 5.

The cone 9 of the belleville washer 8 extends downwardly with the winch in the orientation shown in FIG. 1. Above the washer 8 is a chain wheel having a lower chain wheel part 10. The construction of the chain wheel part 10 will be described further hereinafter. An upper chain wheel part 11 of substantially the same form in the preferred form as the chain wheel part 10 is positioned above the lower chain wheel part 10. The upper chain wheel part 11 carries an upwardly protruding lug 15 on or adjacent the periphery thereof.

An upper belleville washer 16 is positioned above the upper chain wheel part 11 and an upper clutch cone 17 sits above the upper belleville washer 16. An inwardly downwardly extending chamfered face 20 is provided on the upper clutch cone 17. The lower chain wheel part 10 and upper chain wheel part 11 have faces (not shown) and 21 against which the faces 7 and 20 can bear.

A rotational direction limiting device is provided for chain wheel part 11. This can be provided as follows. The upper clutch cone 17 has perimeter saw teeth 22 against which pivotal pawls 23 can bear. Above the upper clutch cone 17 is a clutch nut 27 in the form of a "cup" with parallel teeth 28 on the inner surface thereof. The central aperture of clutch nut 27 is threaded to engage the threads at 4 and a stop 30 is provided on the spindle 1 to limit upward movement of the clutch nut on the threads 4. The stop 30 can be a split collet.

The carrier 24 has an aperture therein through which a pinion 32 extends, positioned so that teeth 33 engage teeth 28.

Figure 2:
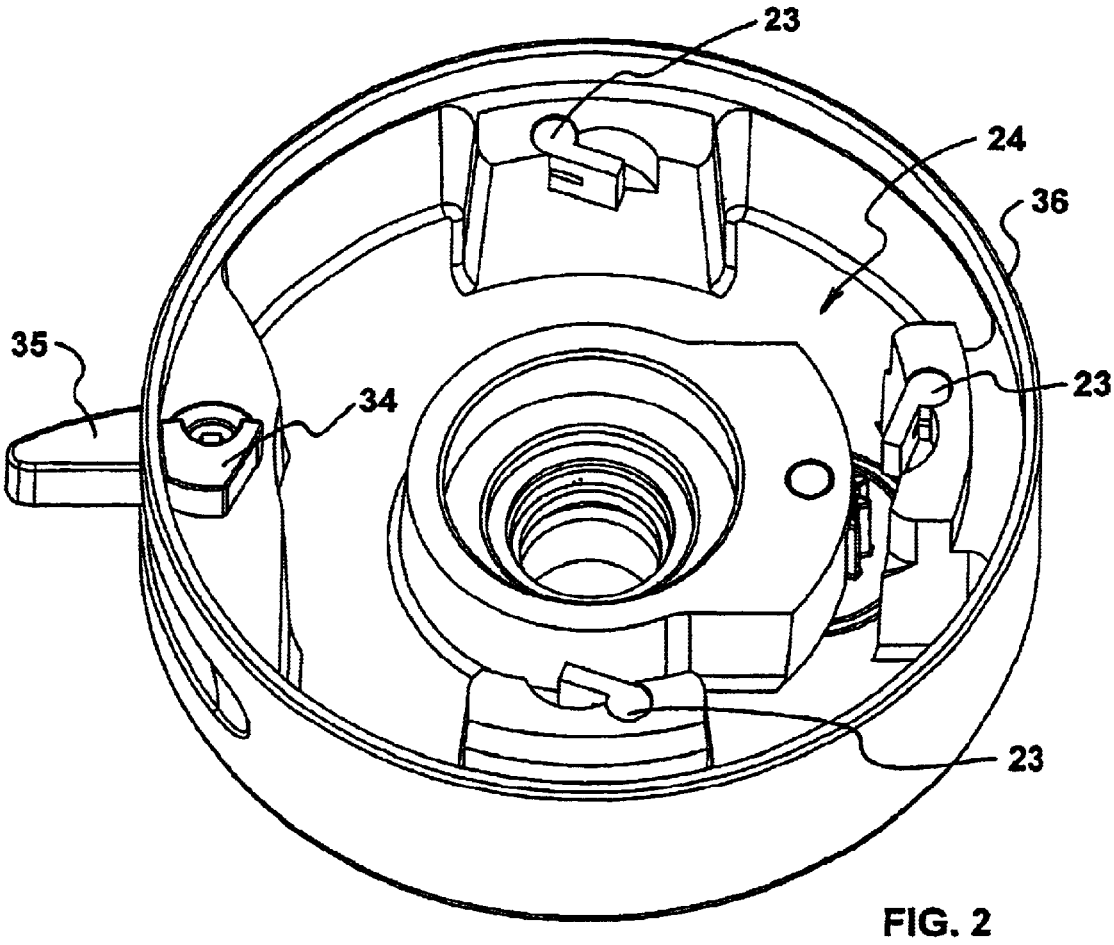
FIG. 2 is a perspective view of a carrier for use in one preferred form of the winch in an inverted position.

The carrier 24 also carries on its inner side, a pivotal dog 34 able to be moved between two positions by a lever 35 which extends outwardly through an aperture in the side wall 36 of carrier 34. In one position as shown in FIG. 2, dog 34 is engaged by lug 15, but in the other position of dog 34, dog 34 is rotated 90° about pivot pin 34*a* and is clear of the path of the lug 15.

The pinion 32 has a connecting face 40 able to be engaged by a handle (not shown).

In use, with the clutch nut 27 initially towards the bottom of threads 4, the chain wheel compresses the belleville washers 8, 16 and the faces 7 and (not shown on the underside of chain wheel part 10), and, 20 and 21 engage. The lever 35 is moved so that dog 34 is clear of lug 15.

If the spindle 1 is then rotated, for example, by means of a motor (not shown) driving through a gear box (not shown) the chain wheel will rotate drawing a rope or chain therebetween. The chain wheel can be rotated clockwise or anti-clockwise to, for example, raise or lower an anchor on a boat.

If, for example, power is lost to the motor, the dog 34 is moved to its alternative position so that dog 34 engages lug 15 as the carrier 24 is rotated.

If the pinion 32 is manually rotated by the handle (not shown), it will firstly rotate clutch nut 27 on threads 4, until the clutch nut 27 engages the stop 30. At this point carrier 24 will begin to rotate. Once dog 34 contacts lug 15 the upper chain wheel part 11 will rotate without rotating spindle 1, as the faces 7 and (not shown), 20 and 21 are no longer in engagement, having been moved apart by belleville washers 8 and 16 once clutch nut 27 has moved upwardly.

Thus the rope or chain between the chain wheel parts 10 and 11 will be raised. Rotation of the carrier 24 and chain wheel parts 10 and 11 in the opposite direction is substantially prevented by engagement of the pawls 23 with the teeth 22 on the upper clutch cone 20, which is keyed to spindle 1.

Figure 3:
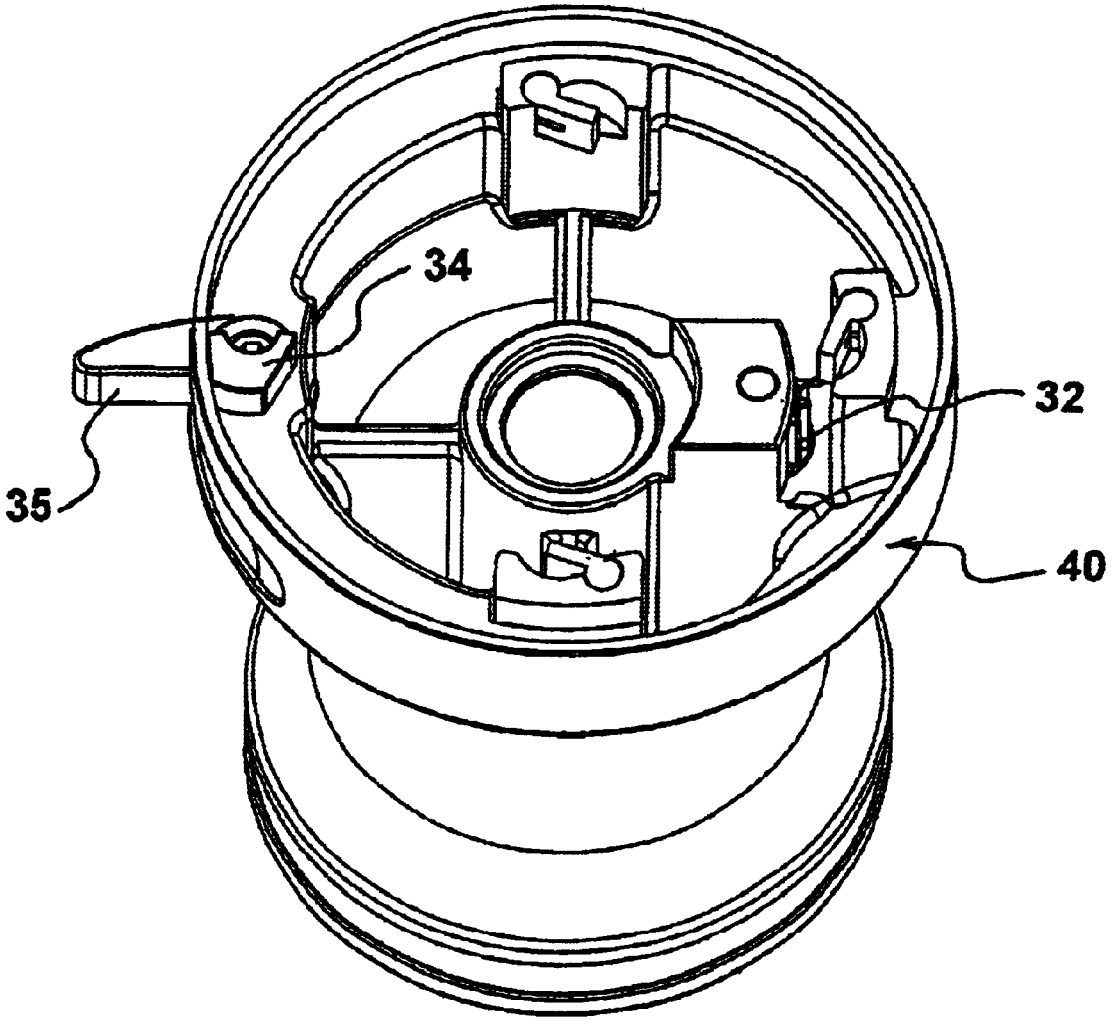
FIG. 3 is a view as in FIG. 2 of an alternative carrier.
Figure 4:
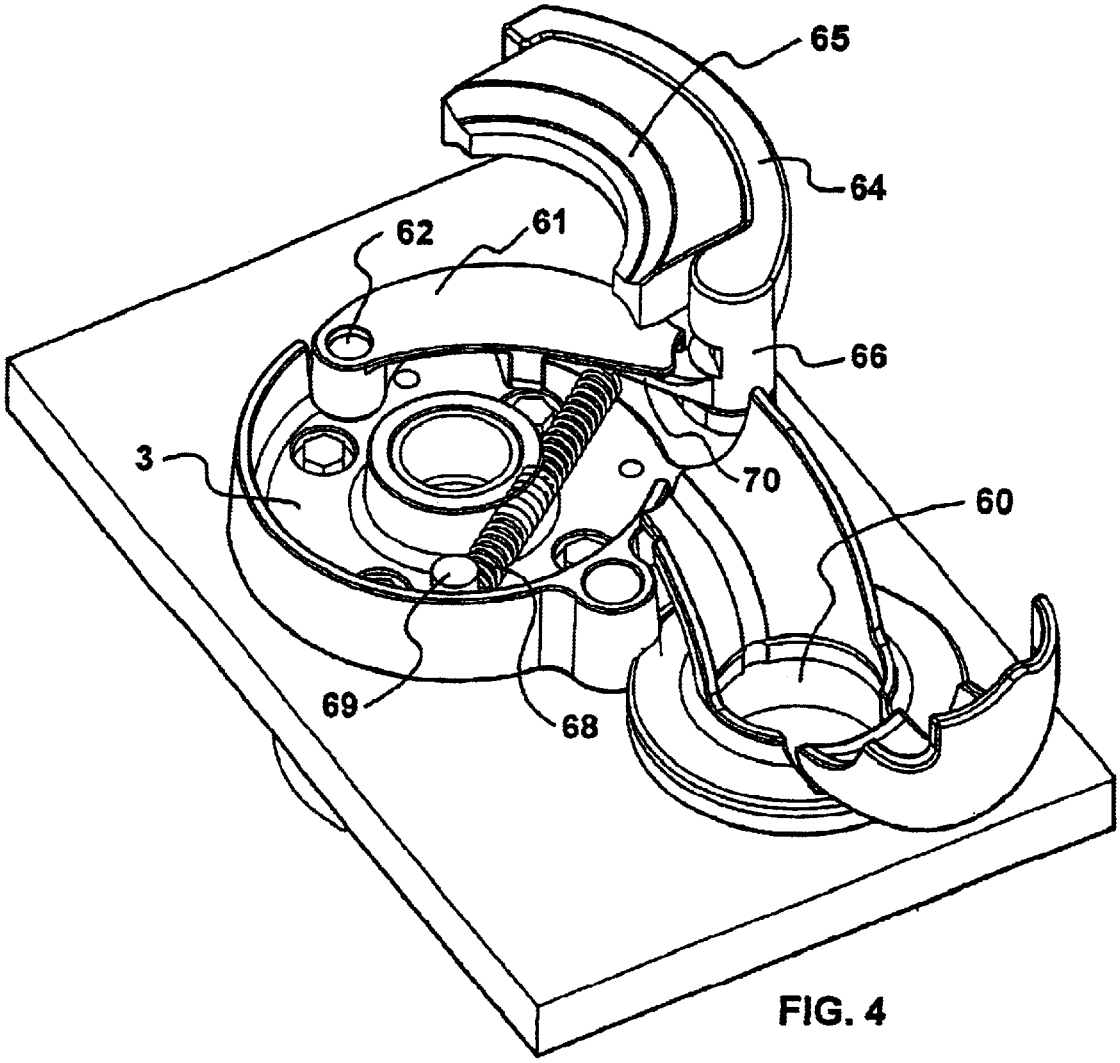
FIG. 4 shows a pressure mechanism for use in the winch of the preceding drawings or in other situations.

In the embodiment of FIG. 3 the carrier is modified to form a capstan 40 and the pinion 32 is mounted on an elongated shaft so as to extend through the capstan 40.

In this embodiment a further mode of operation can be achieved by raising the clutch nut 27 on the threads until movement is prevented by stop 30 and then moving lever 35 so that the dog 34 is clear of lug 15. That is to say, into the opposite position to that shown in FIG. 3. In this position if the motor drives the spindle 1, upper clutch cone 17 is rotated against the pawls thus rotating the capstan 40 without rotation of the chain wheel parts 10 and 11 as the clutch mechanism is disengaged. This allows the capstan to be used to pull a chain or rope separately from the anchor chain, if desired.

In a further embodiment (not shown) the pinion 32 can be moved outwardly and the teeth 28 placed on the outer face of the clutch nut.

The chain wheel parts 10 and 11 in a preferred form, may have a central portion 55 which is extended out of the plane of the chain wheel parts 10 and 11 and upon which teeth, such as teeth 56 are position. At least some of the teeth may carry a spine 57 and, for example, about one in four of the teeth may carry the spine. The teeth 56 do not extend to the periphery of the chain wheel parts 10 or 11, but the spines 57 preferably do so extend, extending across the top or outer most part of the tooth, down the front face of the tooth and outwardly to or adjacent the periphery of the chain wheel parts 10 or 11.

In such a construction the disk is essentially enlarged beyond that of a standard disk, so that the chain wheel provides an extra driving section. This extra section is particularly useful when chain is being driven between the chain wheel, as it will tend to ride into the area between the chain wheel parts 10 and 11 in which only the spines 57 are provided and not the teeth 56. The teeth 56 are still present for use when the chain wheel is driving a rope.

The invention also envisages a guide for a rope or chain being driven by the chain wheel. The guide is positioned essentially at the periphery of the chain wheel and bears against the rope or chain prior to its entry into the hinged chain pipe 60 which may be of substantially known type.

The guide comprises a first arm 61 which is pivotally connected to a base which may comprise in particular the deck plate 3 of the winch. The arm 61 is connected to the deck plate 3, for example, through a pivot pin 62. The general shape of the arm 61 is arcuate to follow the of the periphery of the chain wheel formed by chain wheel parts 10 and 11. Pivotally connected to the first arm 61 is a second arm 64 and this pivot may be by means of a post 67 on arm 61, and a socket 66 on arm 64 or otherwise as desired. The arm 64 is also arcuate in substantially the same manner and extends so that the two arms form an acute angle therebetween and in the preferred embodiment the arm 64 in normal use, substantially overlays the arm 61. The arm 64 carries a pressure member 65 which may bear against the rope or chain, as it passes around the chain wheel formed by chain wheel parts 10 and 11. The arms 61 and 64 are biased into a rest position wherein they are substantially adjacent the perimeter of the chain wheel parts 10 and 11 and this biasing may be achieved by means of a biasing member such as spring 68, connected, for example, to a post 69 on deck plate 3 at one end and to the arm 64 at the other end. The connection to the arm 64 is desirably to a further arm 70 which extends in a similar direction to the arm 64 being, for example, positioned below the arm 61.

Thus in the rest position the arms 61 and 64 are positioned substantially one above the other and adjacent the perimeter of the chain wheel. Should an obstruction such as a splice or otherwise, for example, in a rope where the rope joins the chain, pass about the chain wheel, bearing against the pressure member 65, the arms 61 and 64 will be forced outwardly. However because of the point of connection of the springs 68 to the arm 70 being between the two pivots at 62 and 66, the pressure member 65 on the arm 64 will tend to be moved so that the arm 64 and pressure member 65 move somewhat radially outwardly from the perimeter of the chain wheel parts 10 and 11. Once the enlargement or obstruction has passed, the spring 68 will pull the arms 61 and 64 back to their rest position.

Figure 5:
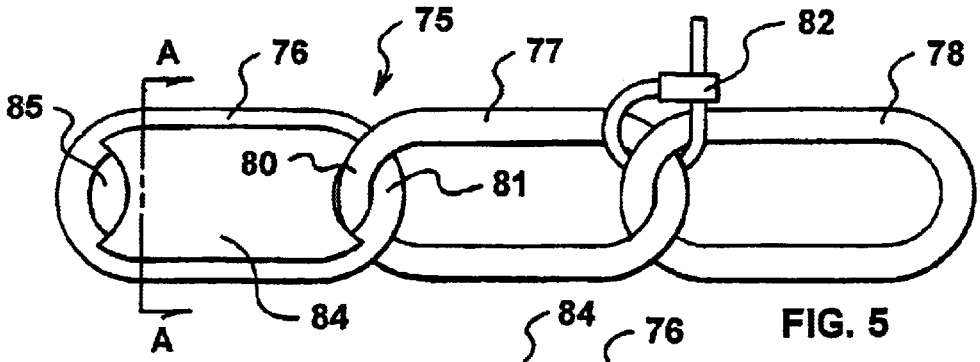
FIG. 5 shows a chain construction usable in the winch of the foregoing figures or in other situations.

Referring now to the construction in FIG. 5, a chain 75 is provided which shows three links 76, 77 and 78. The chain is stiffened by forcing the chain into a position wherein the links are spread and adjacent part of the links such as parts 80 and 81, are closely adjacent. Two methods of achieving this are shown. In the first method a tie, such as a plastic tie 82 is shown about the link. For clarity of the drawing the tie is shown somewhat looser than would be the case in use. In the alternative, a spacer block 84 is provided. The spacer block 84 is shaped to provide a space such as space 85, through which the adjacent link can pass, but which is shaped to allow the links to rotate one relative to the other whilst holding the links apart.

Figure 6:
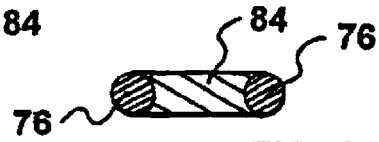
FIG. 6 is a cross-section on "A—A" in FIG. 5.

FIG. 6 shows a cross-section on "AA" of this construction.

Referring to FIGS. 7 to 10, a winch 101 is provided which includes a base plate 102 and suitable driving mechanisms which may be substantially as herein described. A pair of chain wheel parts comprising an upper chain wheel part 11 and a lower chain wheel part 10 are provided, and again these may be as described herein.

Figure 8:
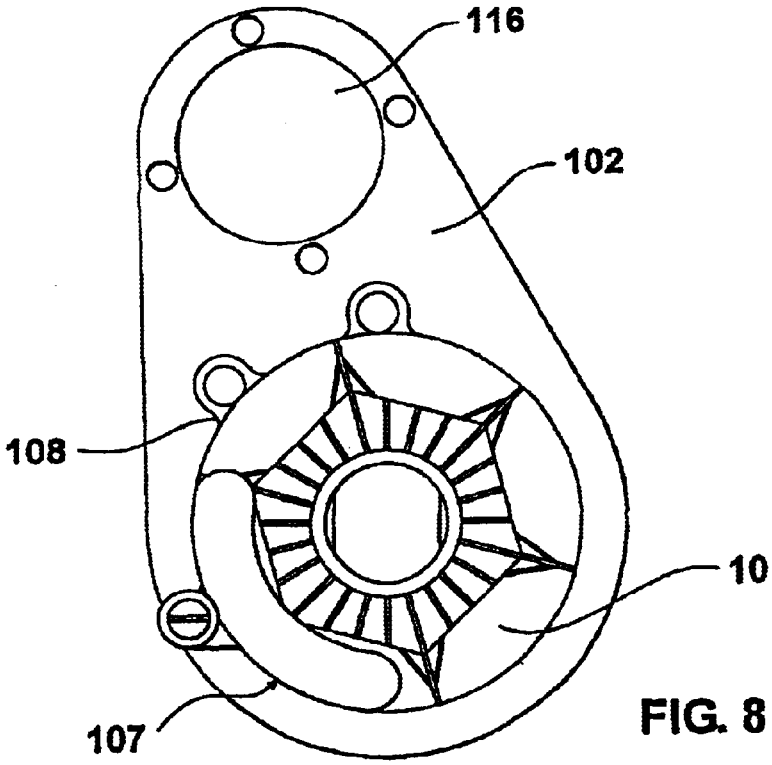
FIG. 8 is a plan view of the base plate of a winch carrying a chain wheel and guide according to one preferred form of the invention, with the guide in an inward position.
Figure 9:
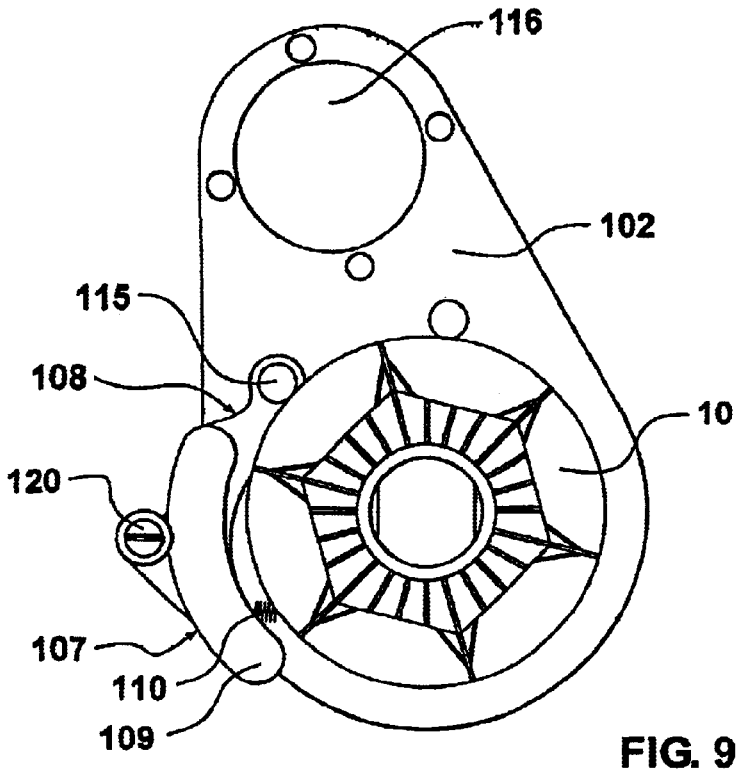
FIG. 9 is a view as in FIG. 8, with the guide in an open position substantially as shown in FIG. 1.
Figure 10:
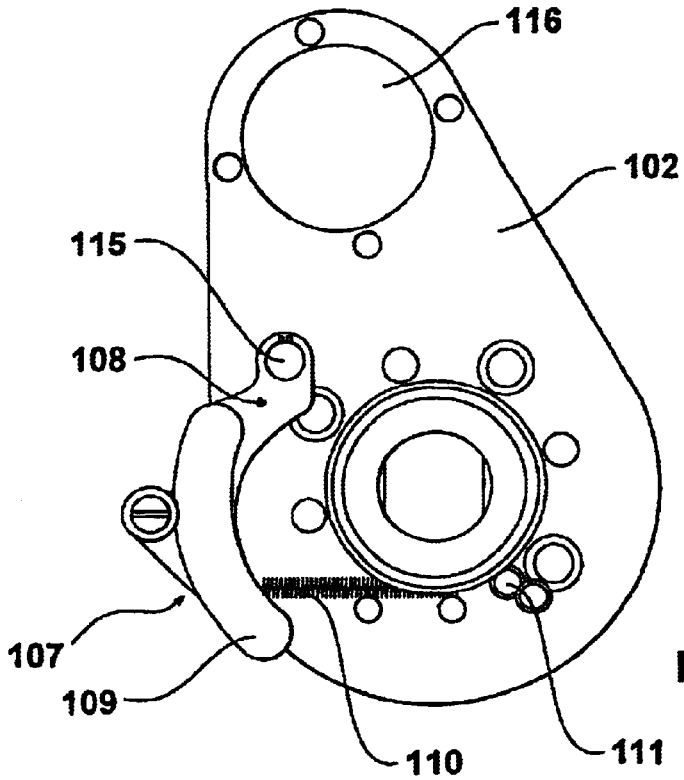
FIG. 10 is a view as in FIG. 9, but with the chain wheel removed.

A guide is provided for a rope or chain passing between the chain wheels 10 and 11. To this end a guide 107 is provided which takes the form of an arm 108, pivotally mounted on the base plate 102, and a pressure member 109 pivotally mounted on the arm 108. In the preferred form of the invention the arm 108, and the pressure member 109, are each substantially arcuate. A biasing member is provided to encourage the arm 108 and pressure member 109 into its inner position substantially as shown in FIG. 8 and the biasing means preferably comprises a spring 110 connected at one end to the arm 108, preferably remote from the point of the pivotal attachment to the base 102 and connected at the other end, for example, to the base plate at attachment point 111.

Figure 7:
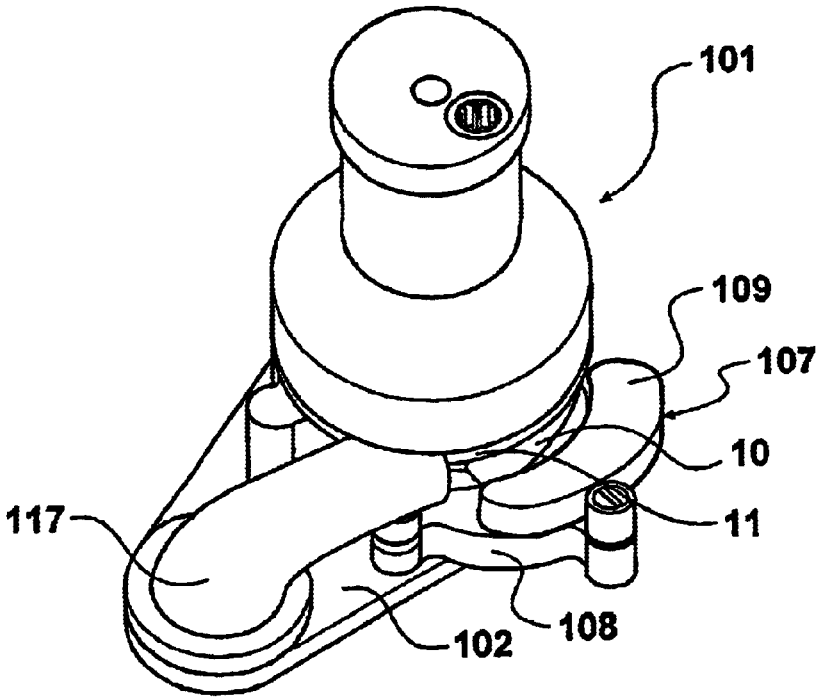
FIG. 7 is a perspective view of a winch according to one preferred form of the invention.

The pivotal connection between the arm 108, and the base plate may be through a pivot pin 115 which is desirably placed adjacent the periphery of the chain wheels 10 and 11, and in what could be regarded as a downstream position in respect of the chain wheels 10 and 11, when the chain or rope is being discharged through aperture 116 in the base plate, that is to say, passing downwardly in use through the tube 117, shown in FIG. 7.

The pivotal attachment between the arm 108, and the pressure member 109, is desirably at a pivot point 120 which is adjacent the convex face of the substantially arcuate pressure member 109. This position is desirably not at the mid point of the pressure member 109, but is displaced towards the end of the arm mounted on the pivot pin 115 in a ratio, for example, of about four:six along the length of the substantially arcuate pressure member 109.

The pressure to be exerted by the biasing spring 110 is substantially empirically determined but needs to be sufficient to keep the pressure member against the chain or rope to act as a guide during normal movement of the chain or rope about the chain wheels 10 and 11, but so that if any obstruction occurs in the chain or rope the pressure member will be moved outwardly to let the obstruction pass without unduly hindering the release or recovery of the chain or rope.

In use in thus embodiment, a chain or rope is passed around the chain wheels 10 and 11, that is to say, between them, and the chain or rope is raised or lowered as normal, for example, as in a boating situation. The inward pressure of the pressure member 109 onto the chain or rope will tend to keep the chain or rope into contact with the chain wheels to facilitate the movement of the chain or rope between the chain wheels. If an obstruction arises, the pressure member will be forced outwardly, this movement being accommodated by rotation of the arm 108 about the pivot point 115, and as necessary by the pressure member 109, about the pivot point 120. Once the obstruction has passed, the biasing spring 110 will return the arm 108 and pressure member 109 to its inward position.

In use, if the chain adapted by either one of these method jams about the winch, it can be pushed from the end remote the hinged chain pipe and the stiffening of the connections between the links will allow pressure to be exerted, thus increasing the chances of being able to be simply push the chain downwardly through the hinged chain pipe.

Thus it can be seen that at least in a preferred form of the invention a winch and associated parts are provided which will have the advantage that a chain can be pushed as well as pulled, and anchor, for example, can be lifted by manual drive, notwithstanding loss of power to the winch caused, for example, by a flat battery and that chain can be readily driven through the winch in a simple yet effective manner which will allow the chain guide to move in a manner that will allow an obstruction in the chain, such as, for example, a splice in a connection between a rope and a chain to move about the pressure arm. Furthermore constructions are described which will enable pressure to be placed on a rope or chain passing between chain wheel parts but which will allow a pressure member to be pushed outwardly if an obstruction in the rope or chain passes about the chain wheel parts.

What is claimed is:

1. A winch, including a chain wheel mounted on a spindle, a clutch to selectively engage or disengage the chain wheel with the spindle, a clutch nut having a central aperture, the clutch nut being movable rotationally and longitudinally on the spindle on mutually engaging threads on the spindle and central aperture, a stop on the spindle to prevent longitudinal movement of the clutch nut away from the chain wheel beyond a predetermined position, a carrier rotatable on the spindle, a rotational direction limiting means between the carrier and the spindle, and rotation means to rotate the carrier with respect to the clutch nut, so that by rotating the rotation means in one direction the clutch nut is moved towards the chain wheel to cause the chain wheel to be rotated by the spindle, and by rotating the rotation means in the opposite direction, the clutch nut moves away from the chain wheel to release the chain wheel from the spindle, engagement of the clutch nut with the stop causing the carrier to rotate thereby rotating the chain wheel without rotation of the spindle.

2. A winch as claimed in claim 1, wherein the carrier has a movable dog and an adjacent chain wheel part has a lug thereon, the dog being manually moveable so that the dog engages the lug when the clutch nut is moved towards the stop, and manually movable so that the lug is free from the dog when the clutch nut is moved away from the stop and towards the chain wheel.

3. A winch as claimed in claim 1, wherein the rotational direction limiting means include a toothed wheel mounted on the spindle to rotate with the spindle and one or more pawls on the carrier.

* * * * *